United States Patent [19]

Wells

[11] Patent Number: 4,930,655

[45] Date of Patent: Jun. 5, 1990

[54] EASY-OPEN CONTAINER WITH NON-DETACHABLE CLOSURE

[76] Inventor: Robert A. Wells, 107 N. Lakeside Dr., Kennesaw, Ga. 30144

[21] Appl. No.: 316,092

[22] Filed: Feb. 27, 1989

[51] Int. Cl.[5] ..... B65D 39/02; B65D 41/04

[52] U.S. Cl. ..... 220/258; 220/259; 220/291; 220/375

[58] Field of Search ..... 220/258, 291, 375, 259, 220/256

[56] References Cited

U.S. PATENT DOCUMENTS

| | | | |
|---|---|---|---|
| 489,329 | 1/1893 | Rosse | 220/291 |
| 1,912,277 | 5/1933 | Kaye | 220/291 |
| 2,286,175 | 6/1942 | Wackman | 220/375 |
| 2,468,758 | 5/1949 | Johnson | 220/375 |
| 4,555,037 | 11/1985 | Rhees | 220/258 X |

*Primary Examiner*—Donald F. Norton
*Attorney, Agent, or Firm*—Thomas & Kennedy

[57] ABSTRACT

An easy-open beverage container with a non-detachable closure assembly includes a container body and integral end wall. In one embodiment, the end wall is formed to defined an opening through which the container contents can be dispensed and a threaded lip extends about the periphery of the opening. Another embodiment reveals that the wall contains a selectively separable region of predetermined weakness defining an openable panel in the wall. An opening and reseal cap has a depending threaded skirt adapted for operative engagement with the threaded lip of end wall. The cap can be threaded onto the lip to seal the can or unthreaded to open up the can for use. An arm is pivotally attached at one end to the can end wall and the cap is rotatably attached to the other end of the arm such that the cap is non-detachably mounted to the end wall through the arm. The cap can thus be unscrewed to open the container and the cap and arm pivoted to displace the cap from the opening for dispensing the container contents. To reseal the container, the cap and arm are pivoted back to align the cap with the opening and the cap is rotated to engage the threads and reseal the container.

27 Claims, 3 Drawing Sheets

EASY-OPEN CONTAINER WITH NON-DETACHABLE CLOSURE

FIELD OF THE INVENTION

The present invention relates to containers and particularly to easily opened beverage containers capable of being resealed after opening.

BACKGROUND OF THE INVENTION

Containers adapted to be opened without the use of auxiliary openers have found widespread acceptance and extensive use in the food packaging industry. Such containers are typically known as easy-open containers with perhaps the best example being the familiar pop-top beverage can often used to contain soft drinks and beer. In more recent years, ecological concerns over detachable pop-tops have given rise to development of easy-open containers having nondetachable opening tabs which remain with the container after it is opened such that the spent container and tab can be discarded as a unit after use.

Various easy-open container designs have become known in the industry. Most of these designs include a container end wall which has a selectively separable panel defined in the wall by a score line. Upon manipulation of an adjacent opening tab, the panel is at least partially separated from the end wall along the score line and can be torn away or pivoted into the container to provide an opening through which the container contents can be consumed or dispensed. Once opened, however, such containers are not easily resealed against spoilage, contamination and decarbonation such that their contents must either be completely consumed or discarded upon opening the container.

While consuming the entire contents of a newly opened container is no problem for some people, others find their appetites satisfied after consuming only part of the contents or for other reasons desire to set aside the container for later consumption. Under these conditions, it is desirable that the container be resealable after opening to maintain the freshness of its contents. Further, resealing a partially emptied container helps prevent spoilage, contamination, decomposition or decarbonation of the contents and resealing refrigerated containers helps prevent the taste of the contents from becoming stale due to commingling with odors of other foods in the refrigerator.

While resealing a glass or plastic bottle with a screw cap is a relatively simple matter, providing an easy-open beverage can which is also resealable has proved a mammoth problem in the beverage can industry. The separable panel of a typical easy-open can is usually deformed or positioned within the can upon opening and is thus unsuitable or unavailable to reseal the opened can. Prior attempts to provide means for resealing an opened can have generally included separate stoppers, purchased as accessories, which snap into the can opening in an attempt to seal the can. These stoppers have generally been inconvenient and ineffective since they are easily lost and often do not conform well with the shape of the can opening.

Attempts to provide an can opening assembly which also serves to selectively reseal the opened can have generally not met with acceptance. Examples of such attempts are illustrated in U.S. Pat. Nos. 3,880,319, 3,807,597, 4,232,797, 4,391,385, 3,281,024, 2,294,102, 3,804,278 and 4,673,099.

SUMMARY OF THE INVENTION

The present invention is a resealable easy-open container or can of the type typically made of aluminum and commonly used to contain beverages such as soft drinks and beer. According to one embodiment of the invention, the container includes an end wall which defines an opening through which the container contents can be dispensed. An opening and reseal cap is adapted to be selectively secured to the end wall covering and sealing off the opening and, once secured, disengaged and displaced when desired to open up the can so that its contents can be dispensed. Another embodiment includes an openable panel closing said opening and defined by a region of predetermined weakness in the wall with the panel being separable to open communication through said opening.

The cap is movably tethered to the can end wall by an arm which is pivotally attached at one end to the end wall with the cap being rotatably attached to the arm's other end. With this configuration and a properly sized arm, the cap is pivotally movable between a first position registered with and overlying the opening for opening or resealing the can and a second position displaced from the opening for dispensing the contents of the can. In its first position, the cap is rotatable about its attachment to the arm to open or reseal the can. In either position, the cap is tethered to the end wall through the arm such that it does not become detached and is always available to reseal the can in the event the entire contents are not consumed.

Thus, a resealable easy-open container is now provided which can be easily and conveniently opened for consumption and resealed if desired to preserve unused contents of the container. The cap pivots into registration with the opening for opening or resealing the container and pivots away from the opening for dispensing the container contents. The cap remains with the container at all times so it is always available to reseal the container and is simply discarded with the container when the contents are depleted.

Accordingly, it is an object of the invention to provide a resealable easy-open container.

Another object of the invention is to provide a container opening and resealing assembly which employs a single element both to open and reseal the container.

A further object of the invention is to provide a resealable easy-open container having an opening and reseal cap which is movably attached to the container.

Still another object of the invention is to provide a container opening and resealing assembly which can be repeatedly employed to reopen and reseal the container.

An additional object of the invention is to provide a container opening and resealing assembly which is relatively simple and economical to fabricate as part of the container.

Other objects, features and advantages of the invention will become readily apparent upon reading the following description when taken together with the accompanying drawings.

DETAILED DESCRIPTION

Figure 1:
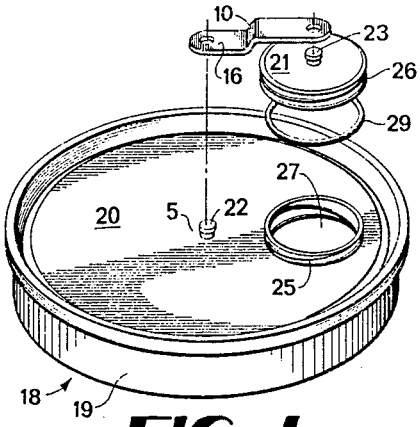
FIG. 1 is a partial perspective exploded view of a container embodying the principals of the invention in a preferred form.
Figure 2:
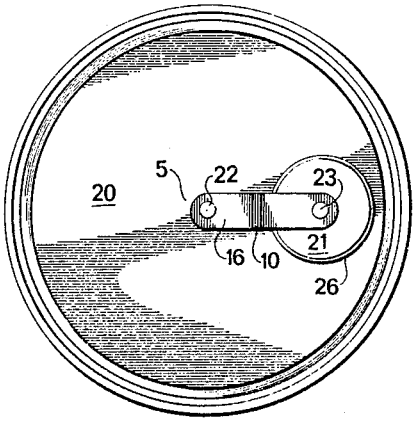
FIG. 2 is a plan view of the container end wall illustrating the opening and resealing assembly in its first position with the cap registered with the container opening.

Referring now in more detail to the drawings in which like numerals represent like parts throughout the several views, FIGS. 1–6 illustrate a container such as a common beverage can which embodies the principles of the present invention in a preferred form. The can 18 comprises a substantially cylindrical body 19 having an integral end wall 20. The end wall 20 has an interior surface 9, an exterior surface 8 and a central portion 5.

The end wall 20 is formed to define a circular opening 27 adjacent the wall periphery through which the container contents can be dispensed. Extending about the opening 27 is a threaded lip 25 preferably formed integrally with the end wall and raised a limited distance above the wall. An opening and reseal cap 21 includes a depending skirt 26 which is also threaded. The diameter of the cap 21 corresponds to the diameter of the opening 27 and the cap threads 26 are constructed to cooperatively engage the threads of the lip 25 such that the cap 21 can be screwed onto the lip 25 to close off communication through the opening and seal the container. The cap can then be unscrewed when desired to open up the container for use. A gasket 29 is expediently positioned within the cap 21 to insure a tight seal when the cap is threaded onto the threaded lip 25.

Figure 3:
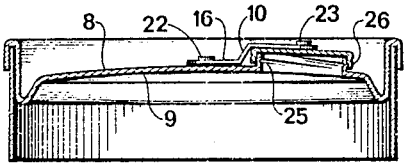
FIG. 3 is a vertical sectional view of the container of FIG. 1.
Figure 4:
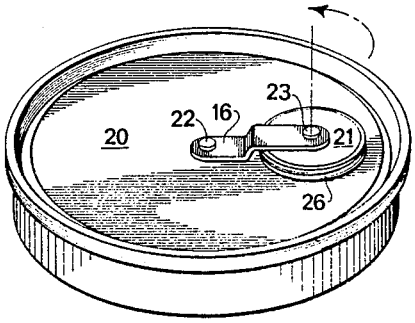
FIG. 4 is a perspective view of the container of FIG. 1 in its sealed configuration.
Figure 6:
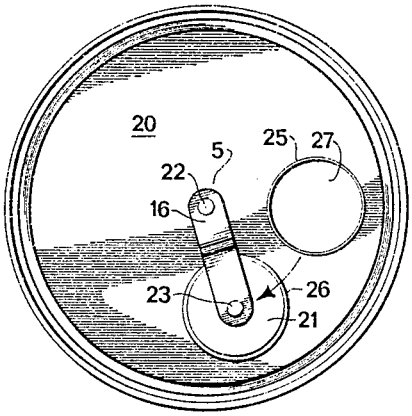
FIG. 6 is a plan view of the container end wall illustrating the opening and resealing assembly in its second position with the cap pivotally displaced from the container opening.

An elongated arm 16 is pivotally mounted at one end to the end wall central portion 5 by a rivet 22 which extends upwardly from the end wall. The cap 21 is rotatably attached to the other end of the arm 16 by a second rivet 23 which extends upwardly from the center of the cap. With this configuration, the cap 21 is rotatable about the axis of its rivet 23 and the arm and cap together can be pivoted about the axis of the rivet 22. The arm 16 is sized to pivot the cap 21 between a first position registered with and overlying the opening 27 for container opening or resealing (FIG. 2) and a second position displaced from the opening as shown in FIG. 6. The first and second positions of the cap lie generally in a plane oriented substantially parallel to the container wall. As best seen in FIG. 3, the arm 16 has a bend 10 which accommodates the height of the cap 21 and the cap is disposed between the raised portion of the arm and the container wall.

Figure 5:
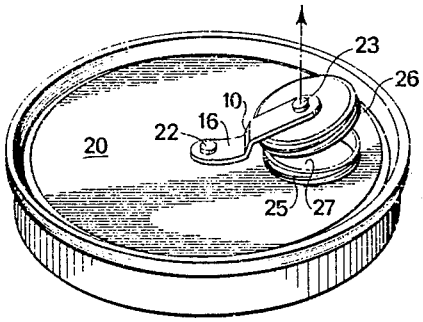
FIG. 5 is a perspective view of the container of FIG. 1 in its opened configuration.

In use, the beverage can of FIG. 1–6 is purchased filled with beverage and sealed by the cap 21 threaded onto the lip 25. To dispense the contents of the can, the cap 21 is simply grasped between the thumb and forefinger and twisted to unthread and separate the cap from the opening as shown in FIG. 5. The disengaged cap can then be raised slightly above the lip and the cap 21 and arm 16 pivoted to displace the cap from the opening so that the contents of the can may be dispensed through the opening.

If the contents of the can are not completely dispensed and it is desired to reseal the container, the cap 21 is simply pivoted back into registration with the opening 27 and rethreaded onto the lip 25 to reseal the can. The can may thus be reopened and resealed as needed until the contents are depleted. The spent can and attached cap and arm are then discarded as a single unit such that the cap and arm do not present unsightly litter.

Figure 7:
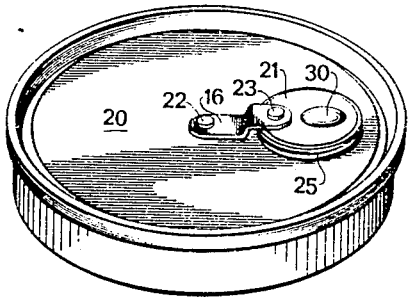
FIG. 7 is a partial perspective view of a modified container embodying the principals of the invention.
Figure 8:
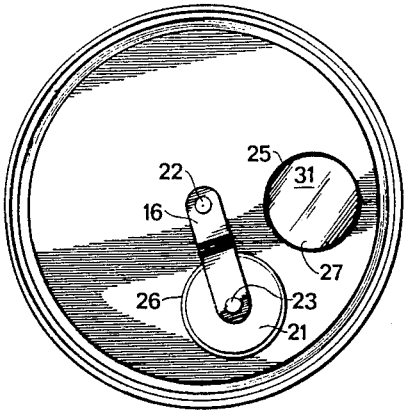
FIG. 8 is a plan view of a container end wall showing the cap displaced from the container opening and illustrating the safety seal covering the opening.

FIG. 7 illustrates a modification of the just described embodiment in which the cap 21 has a raised portion 30 to facilitate grasping and rotating the cap to open and reseal the can. FIG. 8 illustrates a further modification of the foregoing embodiment in which a safety seal 27 made of a satisfactory material such as aluminum foil is sealed about the upper edge of the threaded lip 25 prior to the first opening of the can by a consumer. The seal 31 prevents premature escape of contents or gases within the can as well as providing a tamper indicator. Upon first opening the can, a consumer will simply break the overlaying seal 31 and dispense the contents in the usual way.

Figure 9:
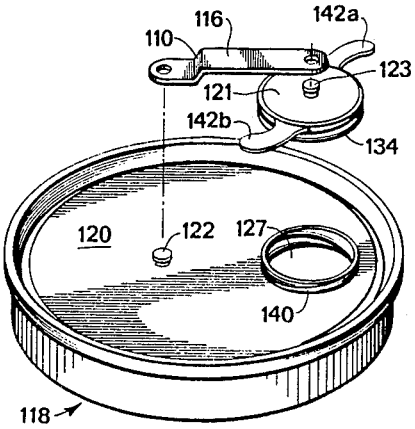
FIG. 9 is a perspective exploded view of a second embodiment of the resealable easy-open container.
Figure 10:
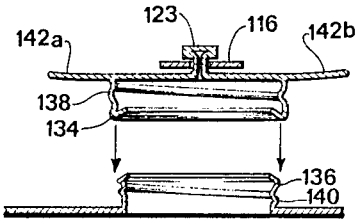
FIG. 10 is a sectional view of the opening and reseal cap of FIG. 9 showing operation of the cap and can engaging means.
Figure 11:
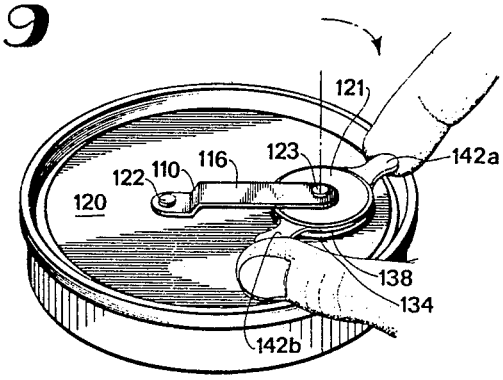
FIG. 11 illustrates a user operating the apparatus of FIG. 9 to reseal a container.
Figure 12:
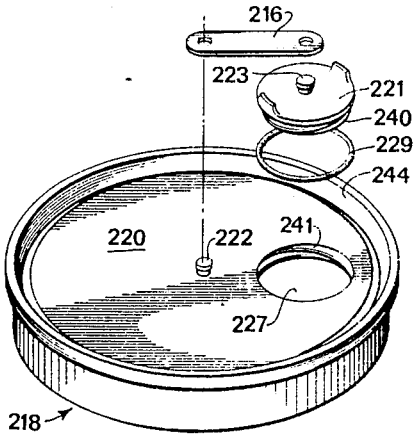
FIG. 12 is a perspective exploded view of a third embodiment of the resealable easy-open container.
Figure 13:
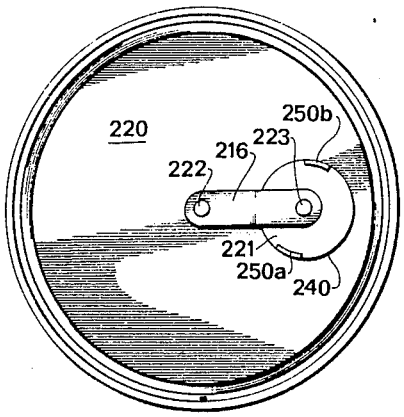
FIG. 13 is a plan view of the container end wall of FIG. 12 showing the opening and reseal assembly in its first position with the cap registered with the container opening.

FIGS. 9–11 illustrate a second embodiment of the invention comprising a beverage can 118 having an integral end wall 120. As with the previous embodiment, the end wall 120 is formed to define an opening 127 and a threaded lip 135 extends about the opening with the lip raised a limited distance above the surface of the end wall 120. The opening and reseal cap 121 has a diameter corresponding to that of the opening 127 and includes a peripheral depending skirt 137 which has a threaded portion 138 and a snap engagement portion 134 (FIG. 10). The lip 135 of the can end 120 also includes a threaded portion 140 and a cooperative snap engagement portion 136 which is adapted to couple in snapping engagement with the snap engagement portion 134 of the cap as the cap is pressed downwardly onto the lip 135.

A pair of a opposed finger grip extensions 142A and 142B are mounted to the cap 121 and extend substantially radially outwardly therefrom as shown in FIG. 9. An arm 116 is pivotally mounted at one end to the end wall 120 by a rivet 122. The cap 121 is rotatably mounted to the other end of the arm by a second rivet 123 which extends upwardly from the center of the cap top. As with the previous embodiment, a bend 110 is formed in the arm 116. In the present embodiment, the bend 110 is spaced from the cap 121 to accommodate the finger grip extensions 142A and 142B as the cap 121 rotates about the axis of its rivet 123 beneath the arm 116.

In use, the container of FIGS. 9–11 is typically purchased by the consumer filled with beverage and sealed by the cap 121. As illustrated in FIG. 11, to open the container a consumer grasps the finger grip extensions between his thumb and forefinger and thereby rotates the cap 121 in a direction to disengage the threaded portions of the skirt 137 and lip 135. This operation may require rotation of the cap through at least one complete revolution in which case the cap and the finger grip extensions rotate beneath the raised portion of the arm 116 and are accommodated by the spaced bend 110 in the arm 116.

Upon disengagement of the threaded portions, the container seal is broken allowing pressure within the can to escape. The cap remains loosely attached to the lip, however, by virtue of the snap engagement portion 134 of the cap and cooperative snap engagement portion 136 of the lip. To completely disengage the cap from the lip, the consumer simply applies upward force to the cap which disengages the two snap engagement portions allowing the cap to be raised above the level of lip. Once disengaged, the cap and arm are pivoted about rivet about 122 to displace the cap from the opening 127 so that the contents of the container be dispensed.

To reseal the container after opening, a consumer simply pivots the cap back into registration with the opening and presses down on the cap to engage the snap engagement portions 134 and 136 of the skirt and lip respectively. The cap then can be rotated with the aid of the finger grip extensions to engage the threaded portions of the skirt and lip and reseal the container.

Figure 14:
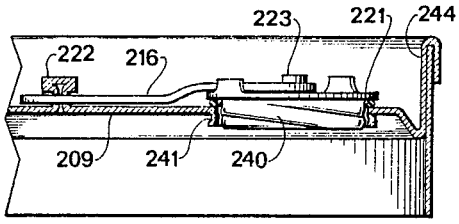
FIG. 14 is a partial sectional view of the container of FIG. 13 in its sealed configuration showing the cooperating cap skirt and annular lip.

FIGS. 12–15 illustrate a third embodiment of the invention wherein the thread lip 241 extends downwardly from the end wall 220 into the interior portion of the container 218. The opening and reseal cap 221 includes a depending skirt which is formed to have exterior threads 240. The cap 221 has a diameter corresponding to that of the opening 227 and the threads 240 of the skirt are adapted to operatively engage the threads of the threaded lip 241 upon rotation of the cap into the opening as best shown in FIG. 14. A gasket 229 can be positioned beneath the peripheral edge of the cap if desired to insure a tight seal when the cap 221 is threaded into the opening 227.

As with prior embodiments, the cap 221 is movably tethered to the can end wall 220 by an arm 216. The arm 216 is pivotably mounted to the can wall at one end by a rivet 222 and the cap 221 is rotatably mounted to the other end of the arm 216 by a second rivet 223. Opposed finger grips 250A and 250B extend upwardly from the periphery of the cap 221 to facilitate manual rotation thereof. A raised chime 244 surrounds the can end wall 220 and has an upper extent above the level of the end wall. The cap 221 and arm 216 are sized and configured such that as the cap is pivoted on the arm between its first position registered with the opening and its second position displaced form the opening, the cap 221 remains below the upper extent of the chime 244. It can thus be said that the first and second positions of the cap 221 as well as its path of movement therebetween lie substantially in a plane oriented generally parallel to the end wall 220 and spaced below the upper extent of the raised chime 244. With this configuration, containers of the type described can be stacked end-to-end without interference form the cap and arm assembly.

Figure 15:
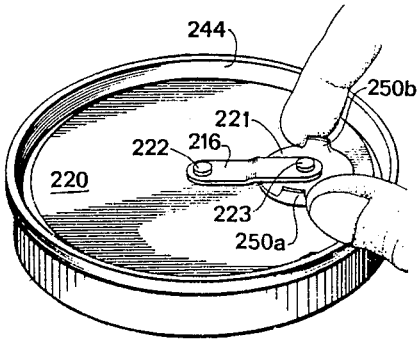
FIG. 15 illustrates a user operating the opening and reseal assembly of FIG. 12.

In operation, a consumer grasps the finger grips 250A and 250B between his thumb and forefinger as shown in FIG. 15 and rotates the cap 221 in a direction to disengage the skirt and lip threaded portions. With the threads disengaged, the cap 221 can be lifted slightly above the surface of the end wall and the cap and arm pivoted about the axis of rivet 222 to displace the cap along the end wall from the opening 227 such that the contents of the can may be dispensed without interference from the cap. To reseal the can, the arm is pivoted back to register the cap with the opening and cap is simultaneously pressed into the opening and rotated to reengage the threads and reseal the container.

With the just described embodiments, it can be seen that the cap 221 is movable along the following six separate paths.

1. A rotational path in a direction to disengage the cap and container threads.
2. Upward movement of the cap away from the opening.
3. Pivotal movement of the arm and cap in one direction to displace the cap from the opening.
4. Pivotal movement of the cap in the opposite direction to realign the cap with the opening.
5. Downward movement of the cap toward the can opening.
6. Rotational movement of the cap in a direction to reengage the threads and seal the container.

Figure 16:
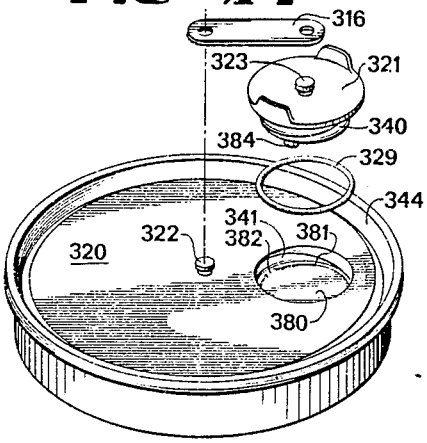
FIG. 16 illustrates a fourth embodiment of the invention having a selectively separable panel sealing the opening.
Figure 17:
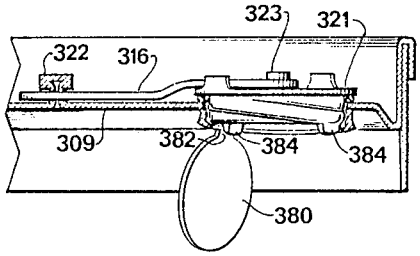
FIG. 17 is a partial sectional view of the embodiment of FIG. 16.

FIGS. 16 and 17 illustrate a fourth embodiment of the present invention. In this embodiment, the can wall 320 is formed to define a circular depression extending downwardly toward the interior of the container with the depression having a depression wall and a depression floor. Threads 341 are formed in the depression wall of with the threads 341 being adapted to mate with the threads 340 of the opening and reseal cap 321 upon registration of the cap with the depression and rotation thereof to engage the threads.

A selectively separable panel 380 is defined in the depression floor by a score line 381 which extends about the periphery of the floor. The ends of the score line are separated to define a hinge portion 382 which remains attached to the depression side wall upon separation of the panel 308 along the score line for hinged movement of the separated panel 380 into the interior of the container as illustrated in FIG. 17.

A pair of pressure pads 384 are formed in the cap 321 and extend downwardly from the threaded skirt thereof such that the pressure pads 384 are disposed adjacent the panel 380 when the cap 321 is threaded into the depression.

With this embodiment, the container is received filled with beverage and sealed by the unseparated panel 380 with the cap partially threaded into the depression. Upon rotating the cap in a direction to move it further into the depression, the pressure pads 384 engage the panel 380 adjacent the score line and the wall of the depression is flexed slightly by the advancing cap. More specifically, as the pads 384 engage the panel 380, a corresponding upward force is exerted on the cap 321.

This force causes the upper surfaces of the cap threads 340 to engage the lower surfaces of the depression wall threads 341. As the cap 321 is rotated further, the engaging thread surfaces tend to exert outward radial force on the depression wall causing it to spread or flex outwardly. The pressure of the tabs and flexing of the depression walls cause the panel to separate along the score line unsealing the container. As the cap is further rotated, one of the pressure pads 384 moves adjacent the hinge portion 382 causing the separated panel 380 to hinge downwardly into the container. The cap is then rotated in the opposite direction to disengage it from the opening formed by separation of the panel and pivoted to displace the cap from the opening to permit contents to be dispensed from the opening. To reseal the container, the cap is pivoted back into registration with the opening, pressed downwardly and rotated to engage the threaded portions of the skirt and depression wall. A gasket 329 can be provided to ensure a tight seal if desired.

The invention has been described in terms of preferred embodiments. It will be understood, however, that many modifications, additions and deletions could be made to these embodiments within the scope of the invention. The attaching rivets, for example, could be either separate elements or formed integrally with the can end wall and cap. Further, any suitable attaching means could be used in place of the rivets. In addition, although the arm has been shown to be simply an elongated element, it could be formed in any expedient shape to accommodate the operation of the cap and the cap could be rotatably attached to the arm by means other than a rivet. These and many other modifications might be made to the invention by a person of skill in the art without departing from the spirit and scope of the invention as set forth in the claims.

What is claimed:

1. An easy-open container with non-detachable closure means including an end wall, an annular lip formed in and bounding a portion of said end wall, a cap member movably mounted to said end wall with said cap member including means for fastening to said annular lip, the improvement therein comprising an openable panel at least partially defined in the bounded portion of said end wall by a selectively separable region of predetermined weakness, said cap member and said annular lip including cooperative engaging surfaces formed to flex at least a portion of said annular lip radially outwardly and separate said openable panel from said end wall upon movement of said cap member in a predetermined direction relative to said annular lip to form an opening in said end wall through which container contents can be dispensed.

2. A resealable easy-open container comprising:

a substantially planar container wall formed to define an opening communicating with the interior of said container;

a raised chime surrounding said container wall;

an easy open and reseal cap member;

said cap member being mounted by an arm to said container wall for movement between a first position registered with said opening and a second position displaced from said opening with said first and second positions lying generally in a plane oriented substantially parallel with said container wall and spaced below the upper extent of said raised chime, said path of movement of said cap member also lying substantially in said plane; and securement means for selectively and releasably securing said cap member to said wall with said cap member covering and closing communication through said opening, whereby the container can be opened by releasing the cap member from securement to said wall and moving it to its second position to allow container contents to be dispensed through the opening whereupon the container can be resealed by moving the cap member back to its first position and releasably securing it to the wall with said securement means, said cap member remaining below the upper extent of the raised chime in all positions.

3. The resealable easy-open container of claim 2 wherein said securement means comprises a threaded annular lip formed in said container wall surrounding said opening and a corresponding threaded annular skirt formed in said cap member, said skirt threads being formed for operative engagement with said lip threads upon registration and rotation of said cap member relative to said opening to secure said cap member to said wall covering and closing communication through said opening, said cap member being released from securement to the wall by rotating said cap in the opposite direction relative to said opening.

4. The resealable easy-open container of claim 3 wherein said annular lip extends outwardly a limited distance from said container wall.

5. The resealable easy-open container of claim 4 wherein the diameter of said annular skirt is greater than the diameter of said annular lip.

6. The resealable easy-open container of claim 4 wherein said cap member includes opposed finger grip extensions positioned to facilitate manual rotation of said cap member.

7. The resealable easy-open container of claim 4 further comprising a first snap engagement portion formed in said lip and a second snap engagement portion formed in said skirt, said first and second snap engagement portions being adapted to couple in snapping engagement upon downward motion of said cap member toward said container wall when said cap member is in its first position whereupon said cap member can be rotated to engage said lip and skirt threads to close said container.

8. The resealable easy-open container of claim 3 further comprising a breakable safety seal spanning and sealing off communication through said opening.

9. The resealable easy-open container of claim 3 wherein said annular lip extends inwardly a limited distance into the interior of said container.

10. The resealable easy-open container of claim 9 further comprising a breakable safety seal spanning and sealing off communication through said opening.

11. The resealable easy-open container of claim 2 further comprising gasket means positioned for sealing engagement with said container wall and said cap member when said cap member is releasably secured to said wall covering said opening to ensure effective sealing of said container.

12. The resealable easy-open container of claim 2 wherein said arm includes spaced first and second portions and is rotatably attached at its first portion to said container wall at a location spaced from said opening with said cap member being operatively attached to said arm second portion, said arm being rotatable about its container wall attachment to move said cap member between its first and second positions.

13. The resealable easy-open container of claim 12 wherein said arm first portion defines a hole and wherein said arm is rotatably attached at its first portion to said container wall by a rivet which extends from said wall through said first portion hole.

14. The resealable easy-open container of claim 13 wherein said securement means comprises a threaded annular lip formed in said container wall surrounding said opening and wherein said cap member includes a threaded annular skirt adapted to mate with said lip upon registration and rotation of said cap member relative to said container wall opening.

15. The resealable easy-open container of claim 14 wherein said cap member is rotatably attached to said arm second portion whereby the cap member can be manually rotated about its point of attachment to said arm when in its first position to engage the lip and skirt threads and thereby secure the cap member to the container wall.

16. The resealable easy-open container of claim 12 wherein a bend is formed in said arm intermediate its first and second portions with said arm first portion being superposed said container wall and said arm second portion being spaced from said wall, said cap member being disposed between said arm second portion and said container wall.

17. A resealable easy-open container comprising:

a substantially planar container wall formed to define an opening communicating with the interior of said container;

a raised chime surrounding said container wall;

a threaded annular lip formed in said wall surrounding said opening;

an opening and reseal cap member;

said cap member including a threaded annular skirt adapted for mating engagement with said lip upon registration and rotation of said cap member relative to said opening;

an elongated arm having first and second end portions and being pivotally attached at its first end portion to said container wall at a location spaced from said opening;

said cap member being rotatably attached to said arm second end portion;

said arm being sized for pivotal movement of said cap member between a first position registered with said opening for selectively opening and resealing said container and a second position displaced from said opening for dispensing contents from the container;

said first and second position of said cap member and the path of movement of said cap member therebetween lying substantially in a plane oriented generally parallel to said container wall and spaced below the upper extent of said raised chime.

18. The resealable easy-open container of claim 17 wherein said lip extends outwardly a limited distance from said container wall.

19. The resealable easy-open container of claim 18 further comprising a first snap engagement member formed in said lip and a second snap engagement member formed in said skirt, said first and second snap engagement members being adapted for mutual snapping engagement upon registration and downward movement of said cap member relative to said opening.

20. The resealable easy-open container of claim 17 further comprising a breakable safety seal spanning and closing communication through said opening.

21. The resealable easy-open container of claim 17 wherein said cap member is movable along six paths with said first path being rotational in a direction to disengage the skirt and lip threads, said second path being upward movement of the cap member away from the opening, said third path being pivotal movement of said arm and said cap member to displace the cap member from the opening, said fourth path being pivotal movement of said arm and said cap member to register said cap member with said opening, said fifth path being downward movement of said cap member toward engagement with said container wall and said sixth path being rotational movement to reengage said lip and skirt threads and reseal said container.

22. The container of claim 17 wherein said annular lip extends inwardly a limited distance into said container.

23. The container of claim 22 further comprising a floor member spanning and sealing off communication through said opening with said floor member including an openable panel defined by a selectively separable region of predetermined weakness and means for selectively separating said panel from said floor member along said line of weakness to open communication through said opening.

24. The container of claim 23 wherein said means for selectively separating said panel from said floor member comprises at least one pressure pad formed in said cap member and positioned for engagement with said openable panel as said cap member is threaded toward said floor member.

25. The container of claim 24 wherein said line of weakness further defines a hinge portion of said panel hingedly attaching said panel to said floor member upon separation of said panel from said floor member along said line of weakness.

26. The container of claim 25 wherein said pressure pad moves adjacent said hinge portion upon separation of said panel from said floor member to hinge said panel into said container.

27. The container of claim 17 wherein said cap member and said elongated arm are independently formed elements.

* * * * *